US009162808B2

(12) United States Patent
Chebli

(10) Patent No.: US 9,162,808 B2
(45) Date of Patent: Oct. 20, 2015

(54) INSULATED FOOD CONTAINER

(75) Inventor: John Kennedy Chebli, Raleigh, NC (US)

(73) Assignee: Global Trading Associates, Inc., Raleigh, NC (US)

( * ) Notice: Subject to any disclaimer, the term of this patent is extended or adjusted under 35 U.S.C. 154(b) by 827 days.

(21) Appl. No.: 13/072,826

(22) Filed: Mar. 28, 2011

(65) Prior Publication Data

US 2011/0192890 A1 Aug. 11, 2011

Related U.S. Application Data

(63) Continuation-in-part of application No. 12/850,034, filed on Aug. 4, 2010, now abandoned, which is a continuation-in-part of application No. 12/701,994, filed on Feb. 8, 2010, now abandoned.

(51) Int. Cl.
*B65D 81/38* (2006.01)
*B65D 81/26* (2006.01)

(52) U.S. Cl.
CPC ..... *B65D 81/264* (2013.01); *B65D 81/3823* (2013.01); *B65D 2585/366* (2013.01)

(58) Field of Classification Search
CPC ..... B65D 81/264; B65D 81/3823; B65D 2585/366
USPC ..... 229/5.84, 403, 902, 906
See application file for complete search history.

(56) References Cited

U.S. PATENT DOCUMENTS

| | | | | | |
|---|---|---|---|---|---|
| 3,428,103 | A * | 2/1969 | Walsh | 206/545 |
| 3,908,888 | A * | 9/1975 | Gordon | 229/5.84 |
| 4,777,053 | A * | 10/1988 | Tobelmann et al. | 229/164.1 |
| 5,110,038 | A * | 5/1992 | Pantisano et al. | 229/906 |
| 5,415,340 | A * | 5/1995 | Calvert et al. | 229/5.84 |
| 5,421,512 | A * | 6/1995 | Poole | 229/5.84 |
| 5,423,477 | A * | 6/1995 | Valdman et al. | 229/104 |
| 5,445,286 | A | 8/1995 | Guimarin | |
| 6,119,928 | A * | 9/2000 | Lasson et al. | 229/5.84 |
| 6,135,273 | A | 10/2000 | Cuen | |
| 6,169,270 | B1 * | 1/2001 | Check | 219/387 |
| 6,200,029 | B1 | 3/2001 | Bonta | |
| 6,932,267 | B2 * | 8/2005 | Potenza et al. | 229/906 |
| 2001/0033903 | A1 * | 10/2001 | Luciano et al. | 229/5.84 |
| 2005/0184141 | A1 * | 8/2005 | Alexander et al. | 229/407 |
| 2007/0114271 | A1 * | 5/2007 | Van Handel | 229/403 |
| 2010/0006561 | A1 * | 1/2010 | Hensel et al. | 219/483 |
| 2010/0193578 | A1 * | 8/2010 | Sanders | 229/5.84 |

OTHER PUBLICATIONS

Metallised film, Wikipedia, http://en.wikipedia.org/wiki/Metallised_film, Aug. 3, 2010.
Polyethylene, Wikipedia, http://en.wikipedia.org/wiki/Polyethylene, Mar. 3, 2011.

* cited by examiner

*Primary Examiner* — Gary Elkins
(74) *Attorney, Agent, or Firm* — James G. Passé; Passé Intellectual Property, LLC

(57) ABSTRACT

The present invention relates to an insulated take home food container. In particular, the present invention relates to a laminate of metallic or non-metallic heat reflective film, either flat or in a manner to create air pockets, utilized to increase the holding time a food stays warm in the container. The container can have flat surface or dividing walls depending on the use of the box.

8 Claims, 4 Drawing Sheets

INSULATED FOOD CONTAINER

This application is a continuation-in-part of U.S. non-provisional application Ser. No. 12/850,034 filed on Aug. 4, 2010, now abandoned which is a continuation-in-part of U.S. non-provisional application Ser. No. 12/701,994 filed on Feb. 8, 2010, now abandoned, all of which are incorporated herein in their entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a container for keeping food warm, moist and fresh. In particular, the present invention relates to an insulated food container designed to keep hot food warmer, more moist, and fresher for longer periods of time.

2. Description of Related Art

Food delivery or takeout food, e.g. fast food, has long been a mainstay within the United States. While most fast food or regular restaurants serve food within their restaurants, a great majority of them offer food to go or delivery of food. Since most fast food is a hot product, best served fresh out of the oven, keeping food warm and moist during delivery or on the drive home has been a difficult problem for decades.

For home delivery, ovens and reusable heavily insulated containers have frequently been utilized. However, for take home use, the container must be of a disposable kind and expensive products are clearly unsuitable. Typically, food is placed in a corrugated cardboard (e.g. as used in pizza boxes), Styrofoam, or other inexpensive material container. While the containers are very inexpensive and do a reasonable job handling moisture collection from hot food, it is not very good at retaining heat and moisture for a very long period of time. The corrugated cardboard or Styrofoam box does a good job in absorbing the moisture, however, it tends to dry out the food and makes it harder.

Several attempts to make a container that insulates better have been made, but mostly expensive solutions have been developed. Since the container must be included in the price of the food, anything that is difficult to make and/or uses expensive materials is unsuitable for a disposable container. Examples of unsuitable boxes include laminated multiple polymers, dual layers of corrugated cardboard with an insulating material certain types. These triple laminates, while an improvement in the heat retention, are too expensive to manufacture when compared to the single layer cardboard container which can be cut out of a flat sheet or stamped to a shape.

It is a need within the industry to have a container which holds heat longer than 10 minutes or so, and keeps the food moist and fresh, yet is inexpensive to manufacture and uses inexpensive materials. Since many companies that deliver food offer 30 minute hot delivery, attempting to keep a food warm for that period without a separate heat source or expensive reusable container would be desirable, but to date has not been achieved.

BRIEF SUMMARY OF THE INVENTION

It has been discovered that a relatively inexpensive and effective hot food container can be made by gluing or otherwise attaching a layer of heat reflective film on the inside of the container, even more insulation can be obtained by gluing the material to the container in a manner such that air pockets are created between the material and the container inner wall surface. In other embodiments the film is laminated to a corrugated cardboard layer on the side facing the food. The container will retain heat with or without the air pocket, but it will retain more heat with the air pocket embodiment.

Accordingly, in one embodiment, there is a food container having at least a portion of the interior, exterior or both surfaces of the container affixed with a layer of a food grade heat reflective film material.

In another embodiment there is a method of manufacturing a cardboard food container comprising:

a) selecting cardboard having a flat paper other layer, a fluted paper middle layer, and a flat inner layer, the inner layer having an inner surface and an other surface, at least one of the inner or other surfaces comprising a heat reflective film material;
b) cutting the cardboard to a desired shape; and
c) folding the cardboard into a container such that the other surface of the inner layer forms the inner surface of the cardboard food container.

DETAILED DESCRIPTION OF THE INVENTION

Figure 1:
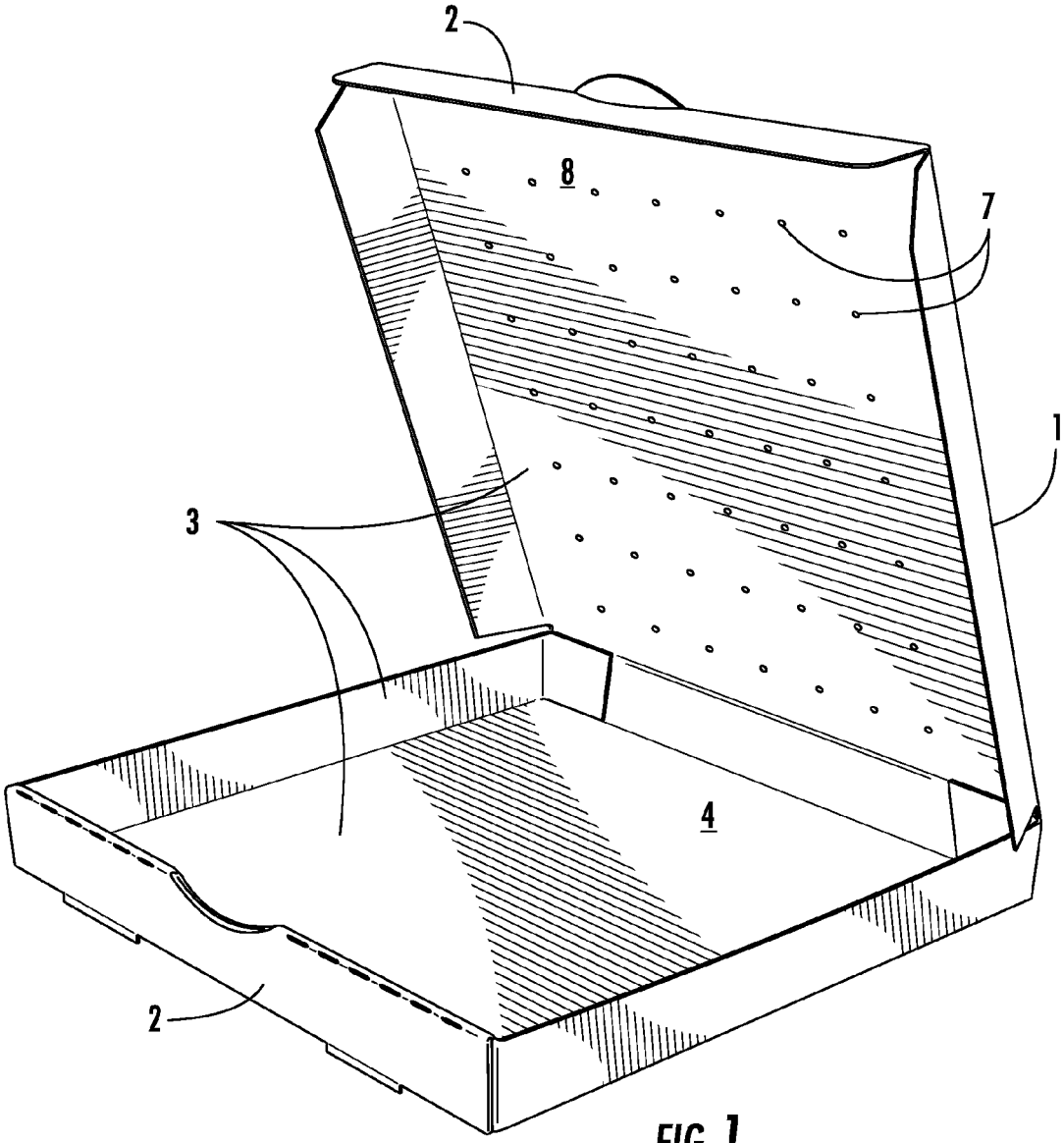
FIG. 1 is a top view of an open container of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein a "food container" refers to corrugated cardboard, plastic, or other stiff material, that has been cut or molded in such a way that when properly assembled creates a three dimensional container or box for placing and transporting a cooked, hot food such as pizza, hamburger, fried food, doggie box food, or the like. Typically, when corrugated cardboard is utilized, it is about a quarter to a third of an inch but various thicknesses can be used within the scope of the present invention. The cardboard or other material can also be perforated to aid in folding and can have printing, such as advertising or information, about the contents that will be in the container, i.e. hamburger. The container is usually held in its three dimensional configuration by tabs that are part of the container, just the general pressure of the material the container is made from against itself, or by any other means known for creating cardboard or polymeric containers. In one embodiment the food container comprises one or more dividers for segmenting different foods in one container. Corrugated cardboard comprises generally three layers, a flat inner and other liner (usually of paper), and a fluted or corrugated paper middle layer. Each flat liner has an other surface and an inner surface, the inner surface facing the corrugated layer.

As used herein "heat reflective film material" refers to any standard or specialty material that is food grade and is capable of reflecting heat and retaining moisture within the container. In addition, the material should be relatively thin in order to accommodate the shape of the box and relatively cost effective. In one embodiment, the material is a metal foil such as aluminum foil. Aluminum foil is used in the cooking and baking industry. In other words, food grade aluminum foil would be utilized since in most cases it will come in contact with a food placed in the container. In another embodiment, the material is a metalize polymer film. Metalized films commonly use aluminum, however, other metals are also used. An advantage of this material is it can be made thinner, and thus cheaper than pure metal foils of the same size. In another embodiment the film is a non-metal reflective film. While these films are not necessarily shinny like metal foils, they exhibit some reflectivness. Commonly these films can be polypropylene, polyethylene (e.g. high density polyethylene HDPE film), nylon, and the like but any food grade polymeric film is acceptable. The reflective material can be smooth, textured, or the like, but in keeping with the spirit of the invention, inexpensive is better than expensive.

The reflective material, such as aluminum foil or non-metallic polymeric film, is affixed to the surface of the container by affixing it to the container's interior or exterior surface. Only a portion may be covered or parts may be covered on either the inside or outside of the container. In one embodiment the film is entirely on the inside of the container. Affixation can be accomplished by gluing, hot melting, extrusion (such as for metalized films), lamination, or any other convenient method for attaching or affixing heat reflective film material to the material of the container that is food safe in nature when used under these circumstances. Gluing can be done after the container is cut as well. One final cut can be made when the container is glued. This will place less holes in the container. In most cases, it will be easier to affix the film to the container by doing so before the material is cut or molded into the final shape for use. Other heat reflective materials may be applied in different manners depending on the particular material and how the container will be assembled or made, or the particular material the container is made of. Glue can be applied entirely over the interior or exterior surface of the container material, in a pattern, or the like, since the aluminum foil, or polyethylene, or other material will stick as long as enough surface is contacted with the glue. In one embodiment, the glue pattern is such that a plurality of air pockets are created between the heat reflective material and the surface of the container. That is, by gluing in a manner that individual areas are completely sealed against the surface of the container, air is trapped in those areas between the foil and the surface of the container. Extrusion methods have the advantage of quickly laminating the surface of the container quickly and cheaply without the need for glue in addition to the foil itself. In these embodiments, a pattern of glue or just heat can be applied, such as diamond, rectangular, or the like, for example, as shown in the figures. The foil and/or the pockets do not necessarily have to be applied to the entire inner or other surface of the container. While it might be simpler to coat the entire side of the container while making the container, applying only on the inner top or other top, for example, could utilize less glue or apply heat only in certain areas. One could also not apply the foil to the sides of the container, however, complete application of the foil to the inside surface of the container is certainly one embodiment of the present invention. Since aluminum foil and HDPE film is relatively cheaper than most container materials, the present invention adds little cost but insulates the container sufficiently and the container can be assembled in the normal manner. The present invention increases the holding time a food will stay warm and moist in the container of the present invention from about 15 minutes to as much as 45 minutes. In another embodiment of the present invention, the film is part of corrugated cardboard used to construct a cardboard pizza box. Cardboard is made by affixing a first flat paper layer, a fluted (middle) paper layer, and a second flat paper layer. By utilizing a reflective film coated paper in the construction of the cardboard, the film will be part of the cardboard, thus avoiding a laminating step. The flat paper layer that forms the inside of the box can consist of film applied to either or both sides of the paper, or a layer of film can replace the paper altogether. The entire inside of the box would be coated with the film when the box is cut from a piece of cardboard so manufactured. In this embodiment non-metallic coatings such as HDPE, allow easier recycling of pieces not utilized in the manufacture of food containers.

In order to deal with any extra accumulated moisture inside the container, the heat reflective film material could be perforated, have holes, be a material that has some permeability to water vapor such as metalized films, or the like, or a layer of moisture absorbing material/paper can be placed in the container (over the food placed in the container) for the purpose of moisture wicking. In one embodiment the inner flat layer or cardboard box consists of film facing the fluted material and paper facing the inside (food side). In other embodiments, a layer of plastic material (such as plastic wrap or a HDPE material) could be placed in the container either between the food and heat reflective material or otherwise to prevent the food from coming in contact with the container surface. The layer could be a film or sheet or other thickness as desired.

The Drawing Embodiments

Now referring to the drawings. FIG. 1 is a perspective view of an open corrugated cardboard container, e.g. for pizza or the like, with the invention lining the inner surface of the box of the present invention. Container 1 comprises other surface 2 and inner surface 3. Other surface 2 is the corrugated cardboard other surface layer of the present invention container 1. Inner surface 3 is heat reflective aluminum foil (or other heat reflective material such as metallic foil or HDPE) 4 lined inner surface. In this embodiment, the heat reflective material is attached to the inner surface of the container in an even manner (e.g. evenly applied glue or the like). In this embodiment, the inner surface of lid 8 is perforated 7 in order to aid with moisture wicking. It is clear that this figure also indicates that the container could have the heat reflective film material on the other surface 2 of the container. In one embodiment, the container could be turned inside out and the container depicted in this figure used to have the heat reflective film material on the other surface 2.

Figure 2:
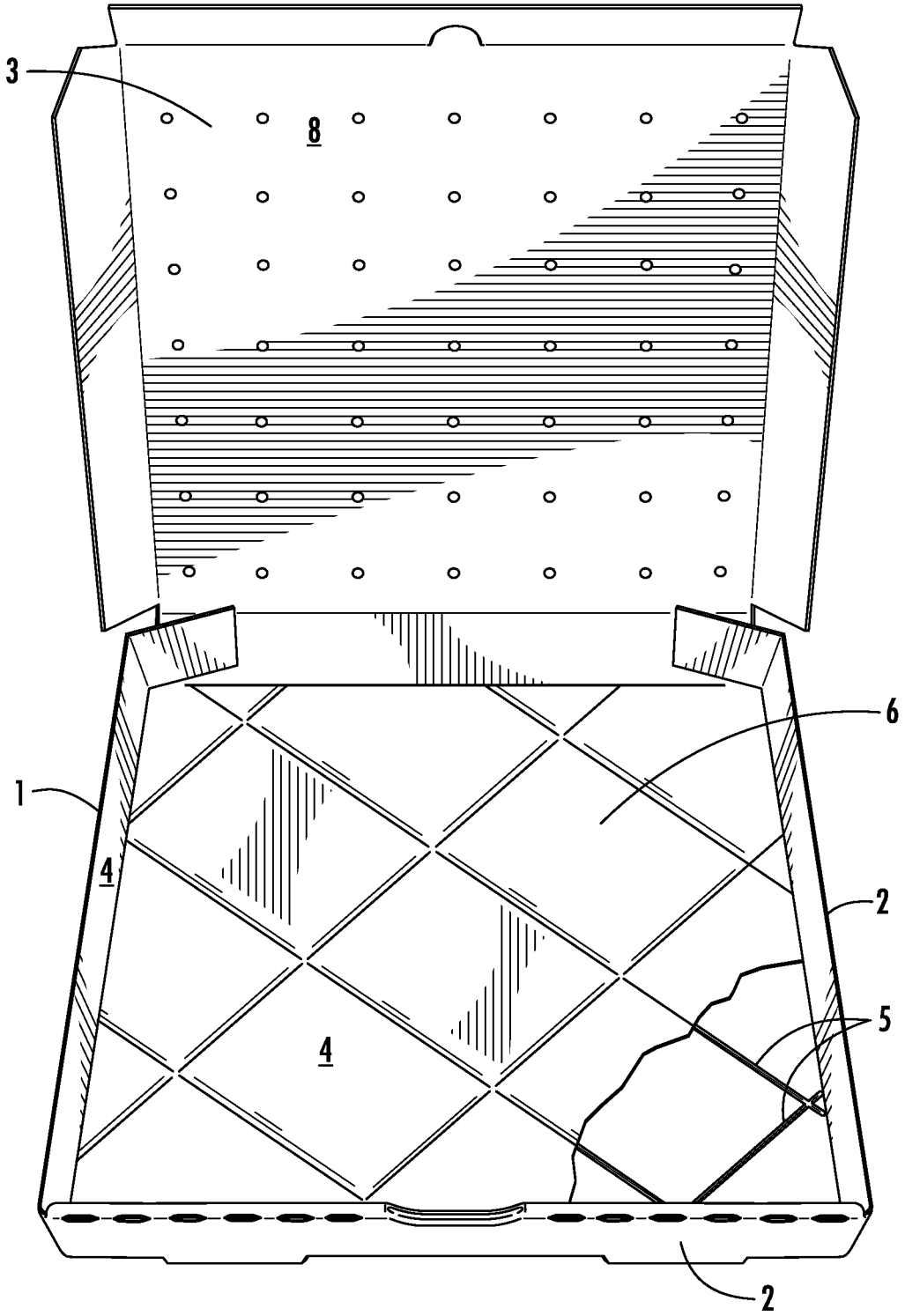
FIG. 2 is a top view of an open pizza box of the invention with air pockets.

In FIG. 2, there is a front perspective of an open container 1 of the present invention. In this embodiment, glue is applied between heat reflective film material 4 and the cardboard box by glue lines 5. These glue lines create pockets 6 which trap air and provide better heat insulation. Note in this embodiment only a portion of the container is lined with the air pockets while the remaining interior is lined with smooth heat reflective material. One could easily vary the percentage of pockets and non-pocket areas as seen fit with the performance of the container. In one embodiment, all the heat reflective film material is attached in this pocket manner.

Figure 3A:
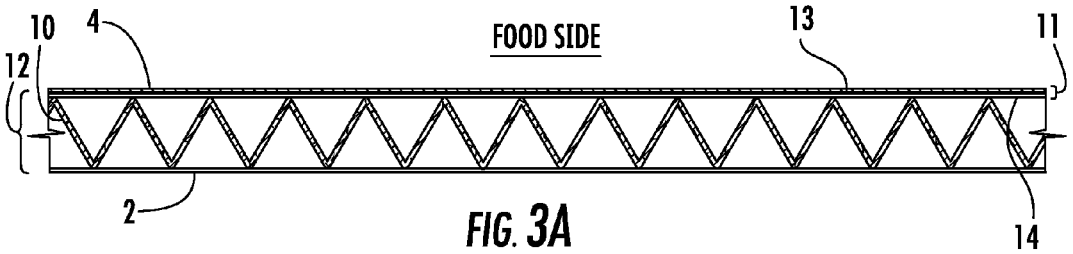
FIGS. 3*a* and 3*b* are cross sections of a food container of the invention.
Figure 3B:
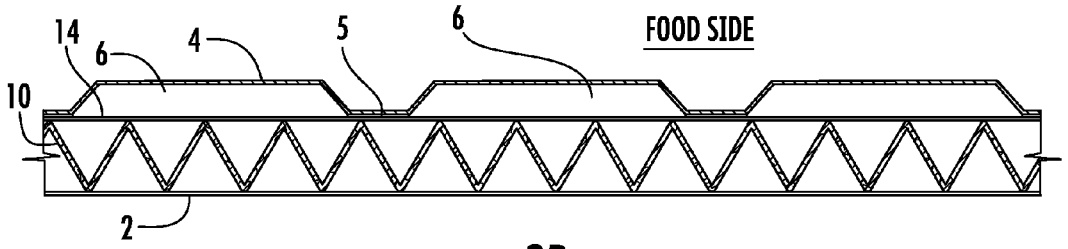
Figure 3C:
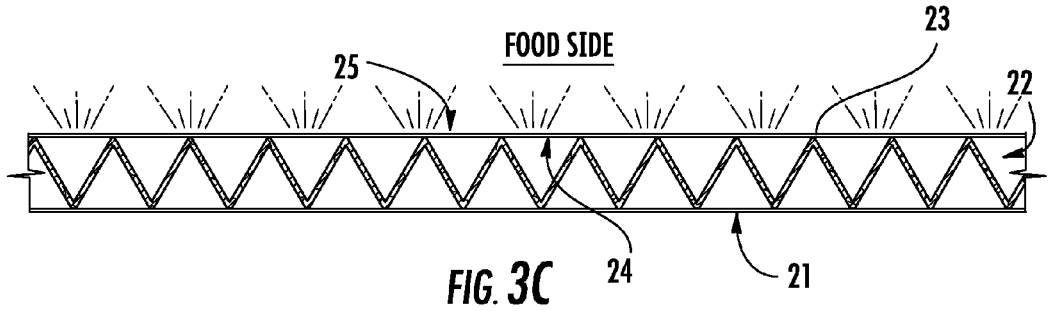

FIGS. 3*a* and 3*b* show cross sections of the corrugated cardboard depicted in FIGS. 1 and 2 respectively and the different positions for film applied container. FIG. 3*a* shows a cross section of the corrugated cardboard box having inside 4 and outside 2 where the heat reflective film material is part of the inner liner 11 of the cardboard. Inner layer 11 consists of two larger food side layer 13 and fluted facing side layer 14 and the film can be either layer with the other layer paper. The heat reflective material is applied in a tight manner with glue or other mastic or extruded thereon, laminated, or otherwise affixed. The inner fluted portion of cardboard 10 can also be seen in the cross section. In FIG. 3*b*, one can see the cross section where air pockets are formed between the inner cardboard liner surface 14 and the heat reflective film material 4. The glue line 5 separates and defines each of the pockets 6 from each other. FIG. 3*c* shows a corrugated cardboard of the present invention wherein the film is the inner flat liner of the cardboard. The corrugated cardboard has flat paper other layer 21 forming the other surface of a pizza box. Corrugated paper middle layer 22 forms the center or middle layer. Flat inner layer 23 forms the inner layer of the cardboard and consists entirely of the film. The inner layer 23 comprises an inner surface 24 which faces middle layer 22 and has center surface 24 which faces middle layer 22 and has other surface 25 which faces the food. In this view there is no paper in the inner layer. The other surface 25 forms the inner surface on a pizza box (or other food container).

Figure 4:
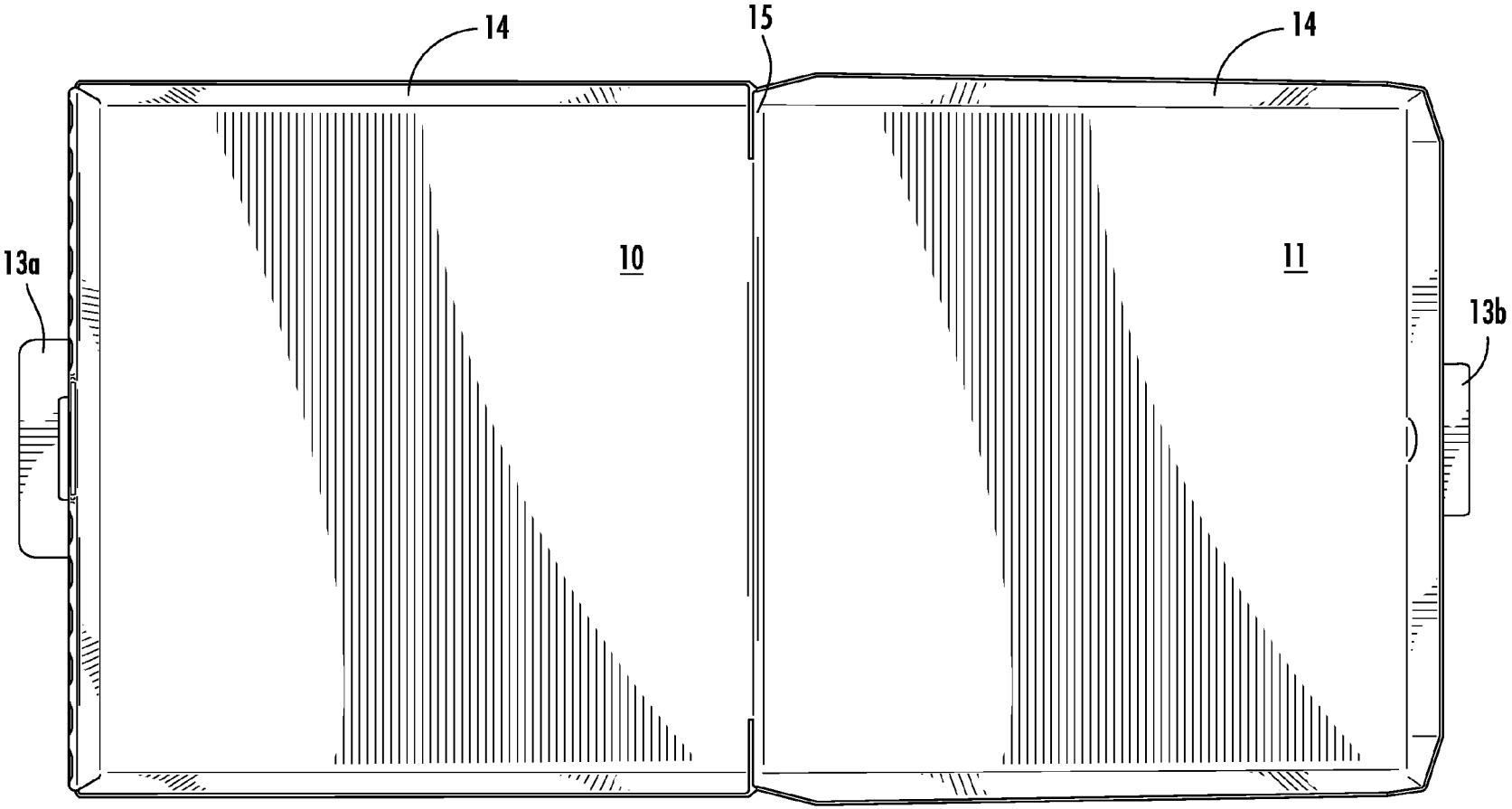
FIG. 4 is a sandwich container of the present invention.

FIG. 4 shows an open sandwich or other such container of the present invention viewed from the top looking at the inside. The bottom 10 and top 11 and entire inside of the container is coated with heat reflective film material 14. The container folds closed at fold 15 and locks closed with tab 13*b* and slot 13*a*.

Examples

Corrugated cardboard boxes were constructed, one with aluminum foil laminated on the entire inside (Box 1), one with HDPE laminated on the entire inside (Box 2), and one constructed entirely of cardboard (Box 3) off the shelf as a control. A pizza at 160 degrees F. was placed in each of the boxes and the pizza temperature measured at 30 minutes and 60 minutes with the following results:

| | 30 Minutes | 60 Minutes |
|---|---|---|
| Box 1 | 130 Degrees F. | 104 Degrees F. |
| Box 2 | 140 Degrees F. | 115 Degrees F. |
| Box 3 | 117 Degrees F. | 91 Degrees F. |

The result is the present invention keeps pizza as much as 26 percent warmer than a cardboard box. Experiments with polypropylene are expected to have similar if not improved results.

Those skilled in the art to which the present invention pertains may make modifications resulting in other embodiments employing principles of the present invention without departing from its spirit or characteristics, particularly upon considering the forgoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A system for keeping a cooked pizza at a safe and edible temperature for at least 30 minutes comprising:

a) a single piece corrugated cardboard pizza box having a flat lid and a bottom, wherein the cardboard consists of a food side innermost heat reflective non-metal film layer, an outermost flat paper layer, and a middle fluted layer;

b) a pizza cooked to at least 160 degrees F. placed in the box, the box being closed thereafter.

2. The system according to claim 1 wherein the non-metal film is a high density polyethylene film or a polypropylene film.

3. The system according to claim 1 which further comprises a loose piece of absorbent material for absorbing moisture from hot food placed in the container.

4. The system according to claim 1 wherein the reflective material has openings for the passage of water vapor.

5. The system according to claim 1 wherein the safe temperature is 140 degrees F.

6. A method of keeping a fresh cooked pizza at a safe and edible temperature for at least 30 minutes comprising:

a) selecting a fresh cooked pizza that has been cooked to a temperature of at least 160 F; and b) selecting an open single piece corrugated cardboard pizza box having a flat lid and a bottom wherein the cardboard consists of a food side innermost heat reflective non-metal film layer, an outermost flat paper layer, and a middle fluted layer;

c) placing the pizza in the corrugated cardboard pizza box; and d) closing the box.

7. The method according to claim 6 wherein the safe and edible temperature is at least about 140 degrees F.

8. The method according to claim 6 wherein the non-metal film is a high density polyethylene film or a polypropylene film.

* * * * *